United States Patent [19]

Milne

[11] 4,341,144

[45] Jul. 27, 1982

[54] BRIDGE STRUCTURE FOR STRINGED INSTRUMENTS

[76] Inventor: Paul A. Milne, 785 Exmouth St., Sarnia, Ontario, Canada

[21] Appl. No.: 229,307

[22] Filed: Jan. 29, 1981

[51] Int. Cl.[3] ..... G10D 3/04

[52] U.S. Cl. ..... 84/307; 84/1.16; 84/299

[58] Field of Search ..... 84/297 R, 298, 299, 84/307, 312, 313

[56] References Cited

U.S. PATENT DOCUMENTS

| | | | |
|---|---|---|---|
| 2,614,449 | 10/1952 | Machalek | 84/312 |
| 2,741,146 | 4/1956 | Fender | 84/313 |
| 4,236,433 | 12/1980 | Holland | 84/1.16 |

FOREIGN PATENT DOCUMENTS

| | | | |
|---|---|---|---|
| 126992 | 1/1902 | Fed. Rep. of Germany | 84/299 |

*Primary Examiner*—Lawrence R. Franklin
*Attorney, Agent, or Firm*—Sim & McBurney

[57] ABSTRACT

There is provided a bridge structure for a stringed instrument. A member supports a ridge over which the strings of the stringed instrument are strung. For each string, one end is secured at a location on the instrument which is remote from the member, the member supporting, for each string, a guide pulley around which the other end of the string passes. Means are provided for snagging the other end of the string, which means includes sub-means on the member whereby rotational torque is applied to the member. Suspension means are provided to support the member from the instrument body in such a way as to counteract that rotational torque.

4 Claims, 6 Drawing Figures

FIG. 1
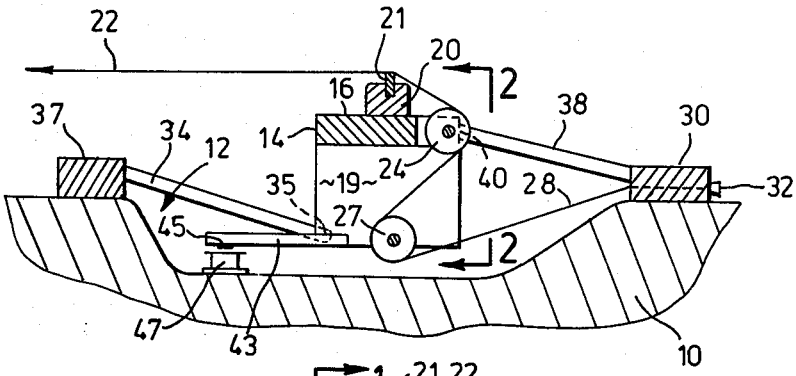
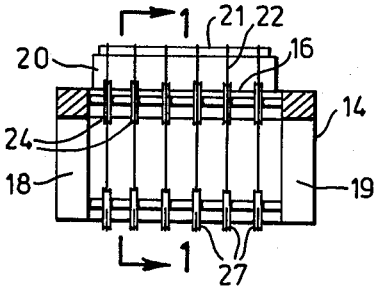
FIG. 2
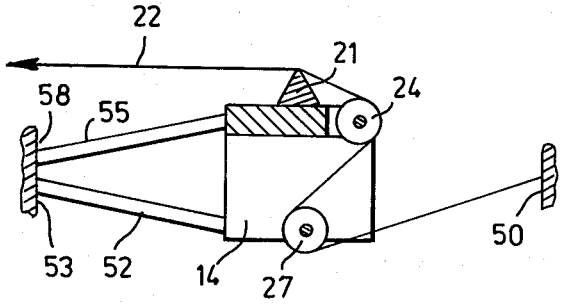
FIG. 3

BRIDGE STRUCTURE FOR STRINGED INSTRUMENTS

This invention relates generally to stringed instruments, and particularly provides a bridge structure for stringed instruments such as guitars, which is such as to allow the vibration in the string to induce on the bridge support structure a vibration which when electrically amplified by standard means, closely resembles the sound of the acoustic version of the same instrument.

It is an aspect of this invention to provide a bridge structure for stringed instruments which is such as to allow a full movement of the bridge structure itself, in response to vibrations of the string.

It is a further aspect of this invention to suspend the bridge structure out of direct contact with the instrument body, but linked thereto by way of tension and/or compression members.

Accordingly, this invention provides a bridge structure for a stringed instrument which includes a member supporting a ridge over which at least one string is strung. One end of the string is secured at a location on the instrument remote from the member, and the member supports a first and a second guide pulley with the other end of the string being entrained around both pulleys in an S-configuration. The terminal part of the other end of the string is secured to the instrument body, and the S-configuration cooperates with tension in the string to give rise to rotational torque on the member. Suspension means supports the member from the instrument body in such a way as to counteract the rotational torque, and means are provided on the member to support at least part of an electronic pick-up device, so that oscillation of the string tension tends to produce rotational oscillation in the member and a corresponding electrical signal in the device.

Five embodiments of this invention are illustrated in the accompanying drawings, in which like numerals denote like parts throughout the several views, and in which:

FIG. 1 is a longitudinal cross-sectional view through the first embodiment of the bridge structure in accordance with this invention, taken at the line 1—1 in FIG. 2;

FIG. 2 is an elevational view taken at the line 2—2 in FIG. 1;

Figure 4:
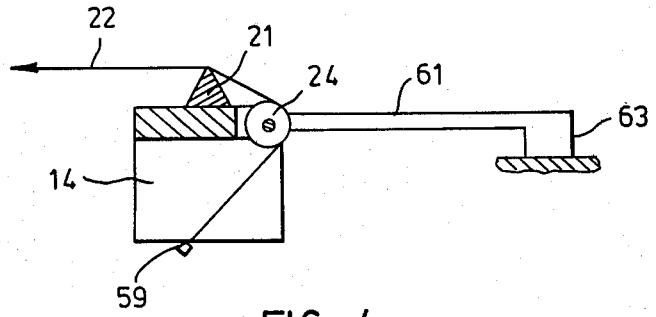

FIGS. 3 to 6 inclusive are schematic views of the second to fifth embodiments of this invention, respectively.

Turning now to FIG. 1, a portion of a guitar body 10 is illustrated, having a recess 12 in which the bridge structure is located. The bridge structure includes a member 14 having top wall 16, and two depending side walls 18 and 19 affixed thereto. The walls 16, 18 and 19 are all rectangular, thus forming a general block-like shape. Supported above the top wall 16 is an element 20 which in turn supports a ridge 21 over which six strings 22 are strung. As can be seen in FIG. 1, the leftward or remote ends of the strings 22 extend away from the bridge structure, and it is understood that these remote ends are secured to the top of the neck of a guitar, in the normal fashion.

For each string 22 there is provided a pulley wheel 24 around which the bridge-end of the respective string passes. As can be seen in FIG. 1, the pulley wheels 24 are located adjacent the ridge 21, and more specifically are located to the side of the ridge 21 which is remote from the upper neck end of the string and at a level below the level of the ridge 21 so that the latter establishes a fixed lower end for the vibrating portion of the string.

Means are also provided for snagging the other end of the string 22, and in the case of each embodiment herein discussed, this additional means includes a modality or sub-means on the member 14. In the case of FIG. 1, this sub-means includes, for each string 22, a further pulley wheel 27 mounted on the member 14, such that each string 22 can be entrained around both of its respective pulley wheels 24 and 27 in an S-configuration, and such that the terminal part 28 of the string can be secured to the instrument body 10. As can be seen in FIG. 1, a mounting block 30 is secured to the instrument body 10, and the mounting block 30 is provided with six slots parallel with the strings 22, the slots extending downwardly from the top of the mounting block 30. Each slot is wide enough to receive one of the strings 22, but each string has the standard knuckle 32 at its terminal end, and the knuckle 32 is too wide to be drawn through the slot. Thus, by dropping the end of the string into one of the sots as shown in FIG. 1, an effective securement is made between the terminal end of the string and the instrument body 10.

It will thus be understood that the arrangement just described will exert a rotational torque on the member 14. More specifically, the rotational torque will be counter-clockwise as seen in FIG. 1, due to the fact that the terminal part 28 of the string is under the same tension as the main part of the string 22, and due to the fact that the pulls of these two string portions are not in line but are offset.

The offset arises due to the arrangement of the pulleys 24 and 27.

It will therefore be evident that some means must be provided to retain the member 14 in the position shown in FIG. 1, since otherwise the tension in the string 22 would cause the member to rotate in the counter-clockwise direction as pictured in FIG. 1.

In order to counteract this rotational torque applied by the strings, a suspension means is provided to support the member 14 from the guitar body 10. More specifically, looking at FIG. 1, there is provided a first tension strut 34 connected at the first end thereof to the member 14 at a lower location 35 thereof, and connected at a second thereof to a mounting block 37 which in turn is secured with respect to the instrument body 10. A second tension strut 38 is also provided, the second tension strut 38 being connected at a first end thereof to the member 14 at a location 40 generally above the location of connection between the strut 34 and the member 14. The other end of the second tension strut 38 is secured to the mounting block 30 which in turn is fixed with respect to the guitar body 10.

It will thus be understood that, due to the offset of the connection locations 35 and 40 for the two struts 34 and 38, the rotational torque applied to the member 14 by the strings is counteracted.

The member 14 supports a cantilevered post 43, which, due to its cantilevered position amplifies the vibration of the member 14 itself. The cantilevered post 43 carries a metal portion 45, which is spaced closely above an induction coil 47 of standard construction. Vibrational movement of the metal piece 45 causes the induction coil 47 to generate an electric signal which corresponds. This is standard technology in the art of electronic pickup of mechanical motion, and does not require further description here.

The embodiments of FIG. 3 to 6 are drawn in schematic or geometric form. Members which have the same or comparable structure and function bear the same reference numerals.

In FIG. 3, the member 14 again supports a ridge 21 over which the string or strings 22 is or are entrained. Also provided is a pulley wheel 24 around which each string 22 passes. From the pulley wheel 24, the string goes to a pulley wheel 27, and thence to a fixing location 50 which in FIG. 1 corresponds to the mounting block 30. Both of the pulley wheels 24 and 27 are again mounted on the member 14.

In order to counteract the rotational torque applied to the member 14 by the tension in the string 22, there is provided a tension strut 52 connected at a first end thereof to the member 14 at a lower location, and secured at a second end thereof to the instrument body, the latter being represented by the fixed location 53. Also provided is a compression strut 55 which is connected at a first end thereof to the member 14 at a location spaced upwardly from the first end of the tension strut 52. Both struts extend in the leftward direction of the string 22, i.e. toward the other location of fixing for the string 22. The compression strut 55 is secured at a second end thereof to the instrument body, this being indicated by the location 58. It will be understood that the tension and compression struts 52 and 55 are placed into tension and compression respectively by being called upon to resist the tendency of the string 22 to rotate the member 14 in the counter-clockwise direction as pictured in FIG. 3. Thus, the struts counteract this rotational torque.

FIG. 4 shows a further embodiment, in which the string 22, instead of having its terminal end secured to the body of the instrument, has this end secured at a lower location 59 of the member 14. The structure shown in FIG. 4, however, includes a pulley wheel 24, and a ridge 21 over which the string 22 is strung.

The suspension means in the case of FIG. 4 is provided by a tension strut 61 which has its first end connected non-articulably to the member 14, and having its other end 63 secured to the instrument body. Due to the non-articulating connection between the tension strut 61 and the member 14, the tension strut 61 is able to counteract the rotational torque exerted by the string 22 on a member 14.

Figure 5:
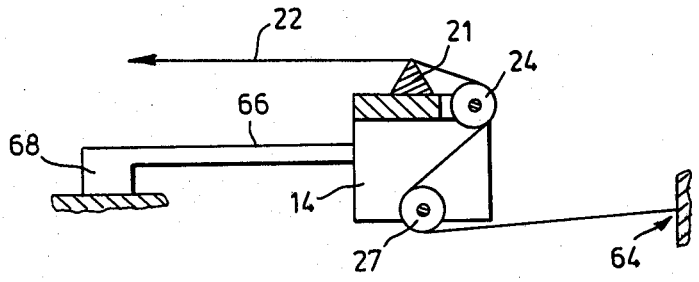

In FIG. 5, the embodiment includes a member 14 identical to the member 14 shown in FIG. 1. The structure thus includes a ridge 21, and for each string 22 a pulley 24 and a pulley 27. As in FIG. 1, the termination of the string 22 is affixed to the guitar body, as represented schematically by the numeral 64.

The embodiment of FIG. 5 departs from that of FIG. 1, however, by providing a single compression strut 66 which is connected at a first end thereof to the member 14, and is secured at a second end 68 thereof to the instrument body, as shown in the figure. The strut is connected to the member 14 in a non-articulable way, so that it is able to resist the tendency of the string 22 to rotate the member 14.

Figure 6:
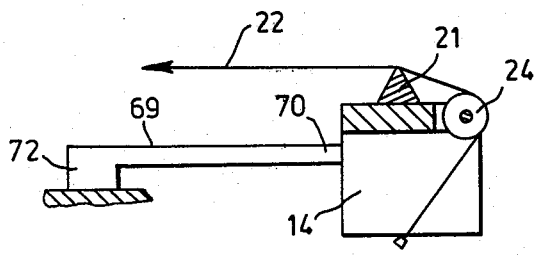

Attention is now directed to FIG. 6, in which the member 14 is provided with a ridge 21 and a pulley 24 for each of the strings 22. The termination of each string 22 is connected at a lower portion of the member 14 itself.

The suspension means, in the case of FIG. 6, comprises a compression strut 69, which is secured at its one end 70 in a non-articulable manner to the member 14, and which is secured at its other end 72, also in a non-articulable manner, to the instrument body. The non-articulable connections at both ends of the strut 69 are required because the strut 69 is the sole support for the member 14. Thus, due to the non-articulating connection between the strut 69 and the member 14, the tendency for the tension of the string 22 to rotate the member 14 in a counter-clockwise direction is counteracted.

It will be understood that, particularly in the embodiments shown in FIGS. 4 and 6, the pulley wheels 24 could be replaced by some simple, non-rotating guide means. This is due to the fact that the string 22 terminates on the member 14 itself, and therefore no purpose is served by having a pulley wheel able to rotate about its axis.

I claim:

1. A bridge structure for a stringed instrument body, comprising:

a member supporting a ridge over which at least one string is strung, one end of the string being secured at a location on the instrument remote from the said member, a first and a second guide pulley secured to the member, the other end of the string being entrained around both pulleys in an S-configuration, the terminal part of said other end of the string being secured to the instrument body, the S-configuration cooperating with tension in the string to give rise to rotational torque on the member, suspension means for supporting the member from the instrument body in such a way as to counteract said rotational torque, and means on the member supporting at least part of a pick-up device, whereby oscillation of the string tension tends to produce rotational oscillation in the member and a corresponding signal in said device.

2. A bridge structure as claimed in claim 1, in which said suspension means includes a compression strut connected at a first end thereof to the member and extending in the direction of said one string end, the compression strut being secured at a second end thereof to the instrument body, the compression strut being rigidly connected to the member in such a way as to be able to resist the tendency of the string connections to rotate the member, the compression strut thus counteracting said rotational torque.

3. A bridge structure as claimed in claim 1, in which said suspension means includes a first tension strut connected at a first end thereof to the member and extending in the direction of said one string end, the first tension strut being secured at a second end thereof with respect to the instrument body, and a second tension strut connected at a first end thereof to the member and extending in the direction away from said one string end, the second tension strut being secured at a second end thereof to the instrument body, the first and second tension struts being connected to the member in an off-set manner such that tension in them counteracts the rotational torque applied to the member by the string.

4. A bridge structure as claimed in claim 1 in which said suspension means includes a tension strut connected at a first end thereof to the member and extending in the direction of said one string end, the tension strut being secured at a second end thereof to the instrument body, and a compression strut connected at a first end thereof to the member at a location spaced from the first end of said tension strut and also extending in the direction of said one string end, the compression strut being secured at a second end thereof to the instrument body; the tension and compression struts being placed into tension and compression respectively by being called upon to resist the tendency of the string connections to rotate the member, the struts thus counteracting said rotational torque.

* * * * *